United States Patent [19]

Heritier-Best

[11] Patent Number: 5,008,643

[45] Date of Patent: Apr. 16, 1991

[54] IGNITION COIL HAVING A DIVIDED HIGH TENSION WINDING, IN PARTICULAR FOR INTERNAL COMBUSTION ENGINES

[75] Inventor: Pierre Heritier-Best, Orbeil, France

[73] Assignee: Valeo Electronique, Issy-les-Moulineaux, France

[21] Appl. No.: 454,150

[22] Filed: Dec. 21, 1989

[30] Foreign Application Priority Data

Dec. 23, 1988 [FR] France ..... 88 17053

[51] Int. Cl.[5] ..... H01F 15/02; H01F 27/30

[52] U.S. Cl. ..... 336/96; 336/198; 336/205

[58] Field of Search ..... 336/96, 205, 198, 208, 336/185, 107; 264/272.19

[56] References Cited

U.S. PATENT DOCUMENTS

| | | | |
|---|---|---|---|
| 4,105,984 | 8/1978 | Smith | 336/96 X |
| 4,268,810 | 5/1981 | Iwasa et al. | 336/205 |
| 4,352,079 | 9/1982 | Mueller et al. | 336/198 X |
| 4,514,712 | 4/1985 | McDougal | 336/198 X |
| 4,517,540 | 5/1985 | McDougal | 336/198 X |

FOREIGN PATENT DOCUMENTS

| | | | |
|---|---|---|---|
| 511801 | 11/1978 | Australia . | |
| 3048803 | 11/1983 | Fed. Rep. of Germany . | |
| 2326769 | 4/1977 | France . | |
| 2593962 | 3/1989 | France . | |
| 329048 | 5/1930 | United Kingdom . | |
| 416541 | 9/1934 | United Kingdom . | |
| 949450 | 2/1964 | United Kingdom | 336/96 |
| 954795 | 4/1964 | United Kingdom . | |

*Primary Examiner*—Thomas J. Kozma

*Attorney, Agent, or Firm*—Wenderoth, Lind & Ponack

[57] ABSTRACT

An ignition coil has a high tension winding divided into sections, each of which is wound in one of a plurality of winding compartments formed in an insulating body and which are spaced apart from each other by insulating compartments. The various sections of the high tension winding are connected in series using the wire of which the winding itself. The high tension sub-assembly is encapsulated in an insulating envelope. The high tension or secondary sub-assembly is impregnated with an adhesive varnish before being encapsulated in a plastics material, the encapsulation being carried out by surface moulding.

2 Claims, 4 Drawing Sheets

IGNITION COIL HAVING A DIVIDED HIGH TENSION WINDING, IN PARTICULAR FOR INTERNAL COMBUSTION ENGINES

FIELD OF THE INVENTION

This invention relates to an ignition coil, in particular for the ignition of internal combustion engines for automotive vehicles, of the kind including a secondary sub-assembly including a divided high tension winding. The different winding sections are distributed in a plurality of winding compartments of an insulating body in which the different high tension winding sections are disposed, each section being spaced apart from the next, in the axial direction of the winding, by an insulating compartment. The sections are connected to each other in series by a wire of the winding passing through each of a plurality of connecting slots, offset successively from each other, which extend through walls which are disposed between the various compartments.

BACKGROUND OF THE INVENTION

In ignition coils, it is necessary to guide a high tension winding wire from an upper end former of a compartment which carries one winding section towards an end former defining the next compartment, and to do this in such a way as to guarantee dielectric consistency between the two neighboring sections.

With this in view, it is known to arrange an insulating compartment between the two successive winding compartments, with the insulating compartment guaranteeing high insulation between the winding compartments and at the same time serving as a conduit for the winding wire joining the two winding compartments. For that purpose, the walls bounding the winding compartments are provided with slots. These slots allow the winding wire to pass from one high tension winding section to the next, in such a way that after one winding section has been fully wound, the wire can be taken through a slot in the wall of the winding compartment concerned and into the insulating compartment, and thence, via the base of the latter, into the next winding compartment so that the forming of the next winding section can be commenced.

In order to improve the insulating effect still further, it is arranged that the slots in the walls should be offset from each other by 180 degrees about the axis of the insulating body on which the winding is wound. An ignition coil which employs such high tension windings is described and shown in French published patent application No. FR 2 326 769A.

When the secondary sub-assembly is encapsulated in an insulating material, for example polybutyleneterephthalate (PBT), the incompatibility of this material as regards its adhesion to the material of which the insulating support member is made, and to the enamel on the high tension winding wire, means that the plastics encapsulating material does not perform a mechanical function, namely that of securing the turns of each winding section with respect to each other and securing these sections in their respective compartments. Consequently, the ignition coil may tend to suffer rapid deterioration. However, the use of PBT is still recommended because of its other qualities, such as the ease with which it can be moulded, its fluidity which allows it to penetrate easily into narrow spaces, and so on.

In order to overcome the disadvanteges set out above, one of the solutions currently used in practice involves, before encapsulation, the impregnation of the whole coil assembly by pouring a resin into the interior of the housing. This process is somewhat delicate, since the integrity of the resin, in both mechanical and dielectric terms, depends essentially on the achievement of high precision in its composition, in the temperature at which it is flowed into the housing, and in the time which it is necessary to allow for it to cure. The equipment for performing this operation is consequently expensive, especially since this equipment must be quite large since the curing time of the resin is very long, being of the order of several hours.

SUMMARY OF THE INVENTION

An object of the present invention is to provide, for internal combustion engines, a no-loss ignition coil in connection with which vapour discharges from the high tension winding, deterioration of the encapsulating insulation, and the resulting short circuits, are all avoided.

To this end, the invention provides an ignition coil of the kind including a secondary sub-assembly comprising a divided high tension winding, in which the different winding sections are distributed in a plurality of winding compartments of an insulating body in which the different high tension winding sections are disposed, each winding section being spaced apart from the next in the axial direction of the winding by an insulating compartment. The said sections are connected to each other in series by the wire of the winding passing through each of a plurality of connecting slots, offset successively from each other, for example by 180 degrees, which extend through the walls bounding the winding compartments and the insulating compartments. The the sub-assembly is encapsulated with an insulating envelope, wherein the secondary sub-assembly is impregnated with an adhesive varnish prior to the encapsulation of the secondary sub-assembly by surface moulding of thermoplastic material or the like.

The description that follows, which is given with reference to the accompanying drawing and by way of example only, will enable the invention, and how it can be put into practice, to be better understood.

DESCRIPTION OF PREFERRED EMBODIMENT OF THE INVENTION

Figure 1:
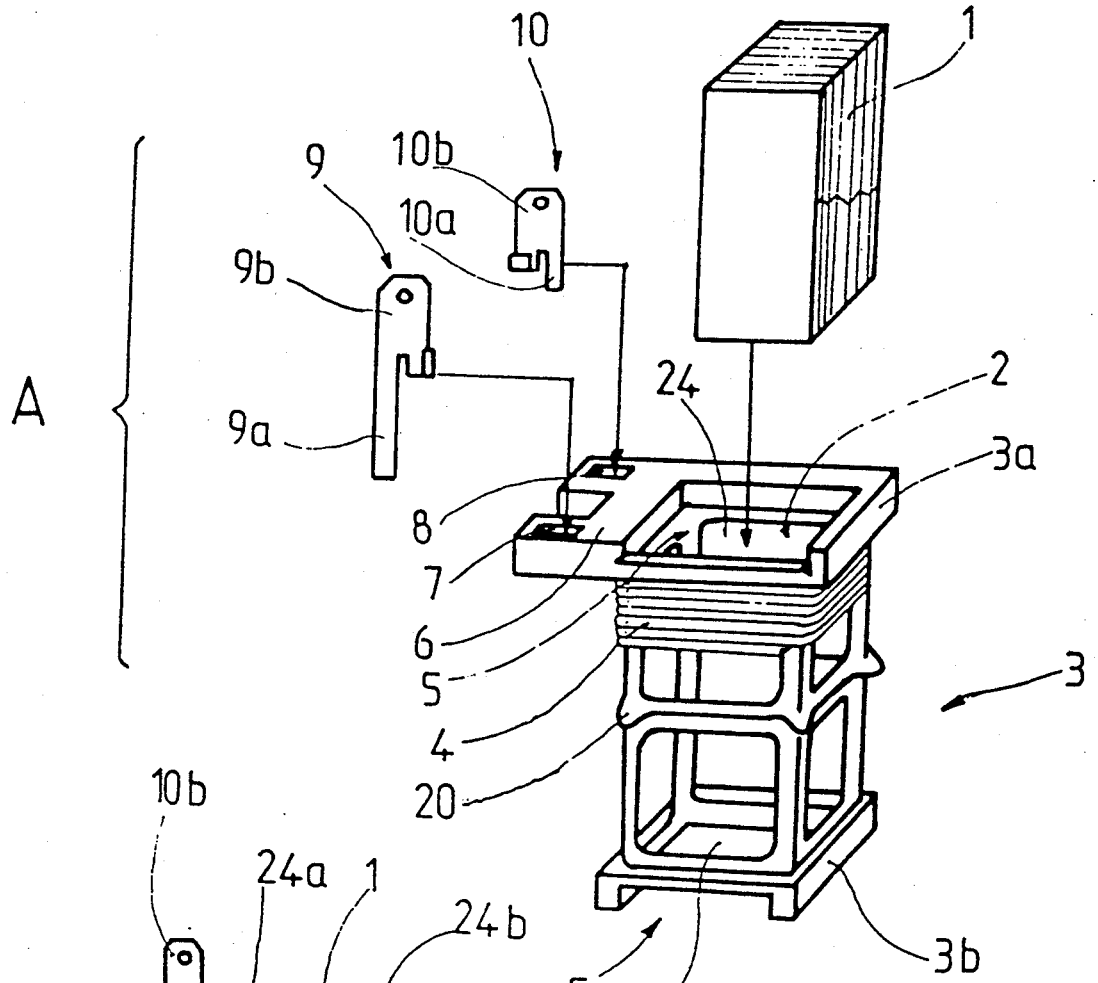
FIG. 1 is an exploded perspective view of the primary sub-assembly of the ignition coil to which the invention is applied.
Figure 2:
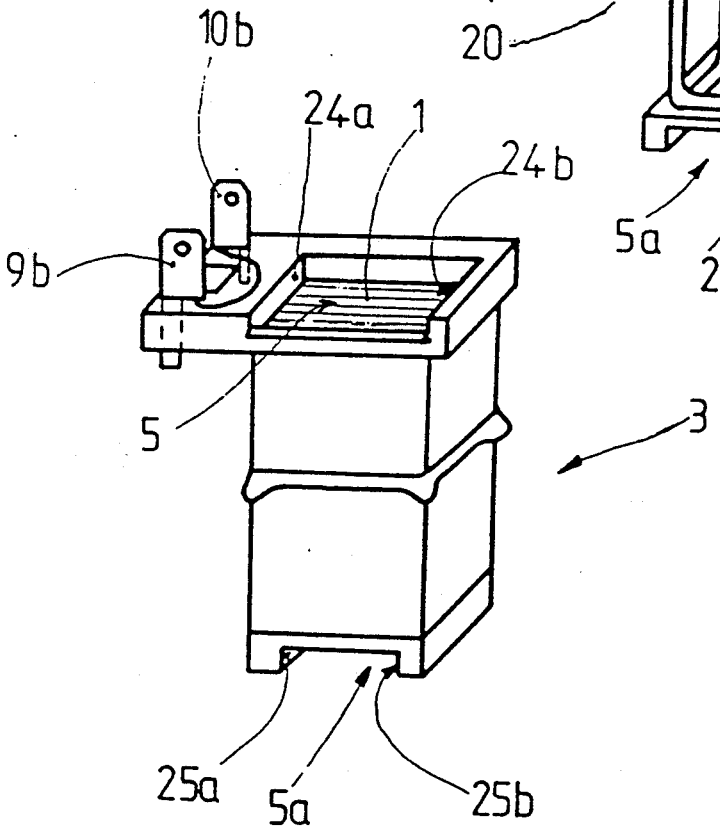
FIG. 2 is a perspective view of the primary sub-assembly of FIG. 1, shown assembled.

FIGS. 1 and 2 show a sub-assembly A of the primary side of the coil, comprising a magnetic core 1, generally of "I" section, which is mounted in a central gap 2 of quadrangular cross section of a body 3. The latter is made of a plastics material such as polybutyleneterephthalate reinforced with 30% short glass fibers. The primary winding 4 is wound on the outside of the body 3.

The core 1, in a known manner, comprises a stack of pressed sheet metal laminations suitably held together. In order to prevent the formation of burrs during assembly, the laminations are preferably secured together by welding or by use of a laser.

An upper cheek portion 3*a* of the insulating body 3 is integrally extended sideways in a ledge 6 having two holes 7 and 8, which are engaged, respectively, the connecting tails 9*a* and 10*a* of two connection terminals 9 and 10, which are referred to respectively as "+BAT" and "−RUPT". The other ends of the connection terminals 9 and 10 are formed in a known manner as male terminal tags 9*b* and 10*b*, to which the ends of the primary winding 4 are soldered.

Figure 3:
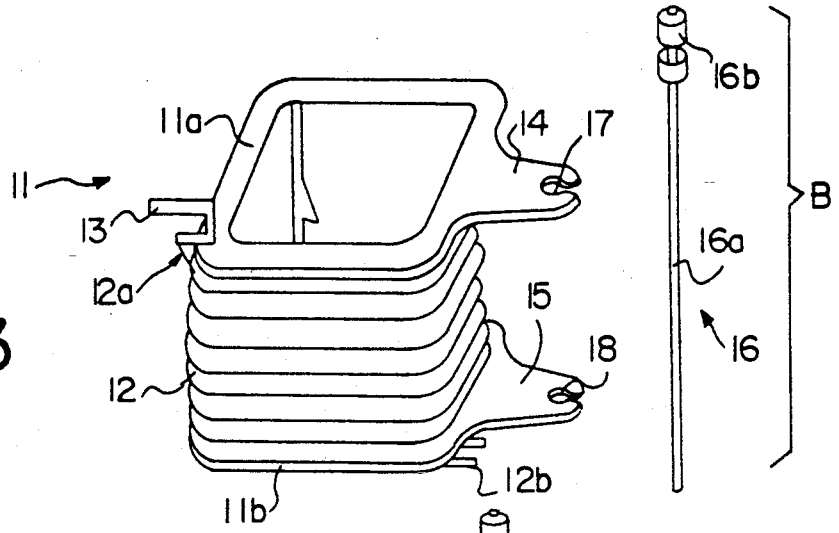
FIG. 3 is an exploded perspective view of the secondary sub-assembly of the same ignition coil, after being impregnated with varnish but before being encapsulated.
Figure 4:
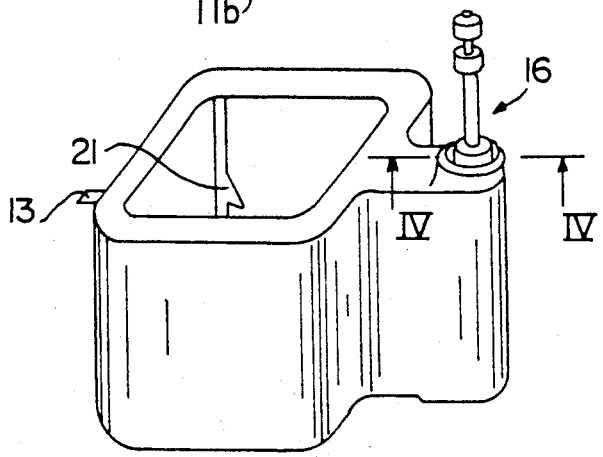
FIG. 4 is a view similar to FIG. 3, but shows the secondary sub-assembly after it has been encapsulated in plastics material.

Referring now to FIGS. 3 and 4, the secondary side of the coil comprises a sub-assembly B, having a body 11 of quadrangular cross section, which is again made of reinforced polybutyleneterephthalate. The secondary winding 12 is wound around the body 11, with an upper end 12*a* of the secondary winding being soldered to a tag type connector 13 secured on an upper face 11*a* of the body 11.

Figure 3A:
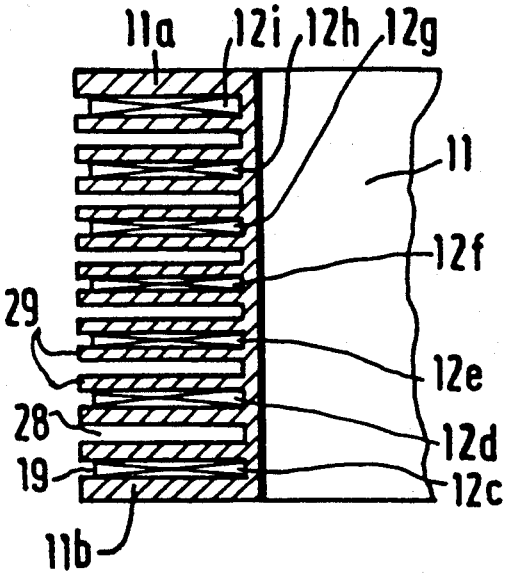
FIG. 3A is a view in vertical transverse cross section generally bisecting the components seen on the left hand side of FIG. 3, in a plane containing the line IV—IV seen in FIG. 4.
Figure 4A:
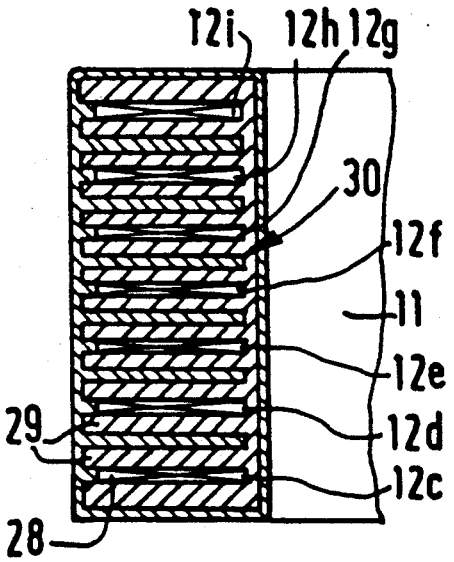
FIG. 4A is a view similar to FIG. 3A, but shows the encapsulated sub-assembly, being taken in the same plane containing the line IV—IV in FIG. 4.
Figure 6:
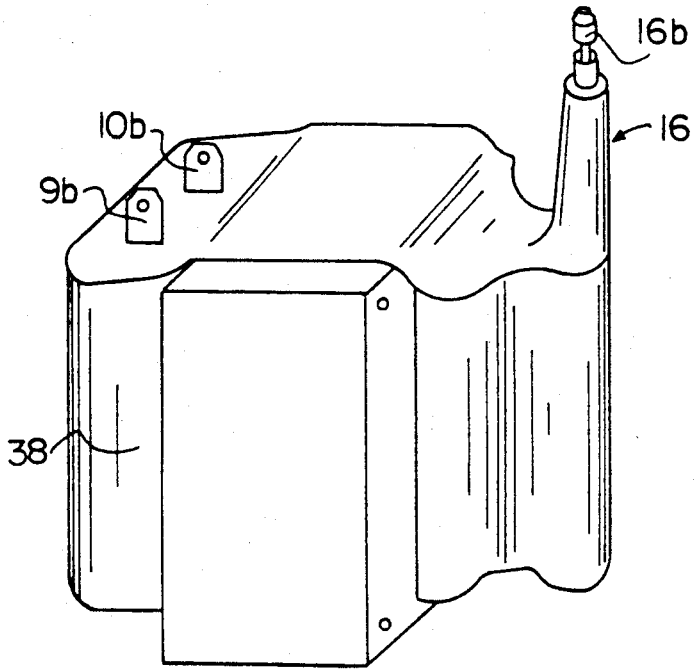
FIG. 6 is an outside perspective view of the completed coil.

The upper face 11*a* and lower face 11*b* of the body 11 are extended laterally in two respective ears 14 and 15, parallel to each other, with a high tension output terminal 16 resiliently anchored to the outer ends of these ears. The terminal 16 lies parallel to the axis of the body 3 of FIG. 1. Its resilient mounting is achieved by means of open slots 17 and 18 which are formed in the outer ends of the ears 14 and 15, and an entry portion narrower than an elongated shank portion 16*a* of the terminal 16. The shank 16*a* is preferably formed from conductive metal wire. The terminal 16 also includes an external stud or knob 16*b* on the end of the shank, and constituting a male member which stands free of the remainder of the coil once the latter has been completed, as can be seen in FIG. 6. As is shown more particularly in FIGS. 3A and 3B, the secondary or high tension winding 12 is divided between a plurality of compartments 19 formed in the insulating body 11. The compartments 19 are spaced apart from each other in the axial direction of the secondary sub-assembly B by means of insulating compartments 28, the latter being preferably of the same dimensions as the winding compartments 19. Various sections 12*c* to 12*i* of the high tension winding 12 are connected together in series by the wire of the winding 12 itself. The winding compartments 19 and the insulating compartments 28 are defined between walls 29.

The arrangement whereby insulating compartments 28 are established between the winding compartments 19 affords a considerable advantage to the high tension winding. It enables the rise in voltage from one winding section to the next to be limited to a predetermined and uniform value, while the various degrees of rise in voltage are protected from being affected by each other due to the insulating zones or the provision of sufficiently long leakage paths.

Figure 3B:
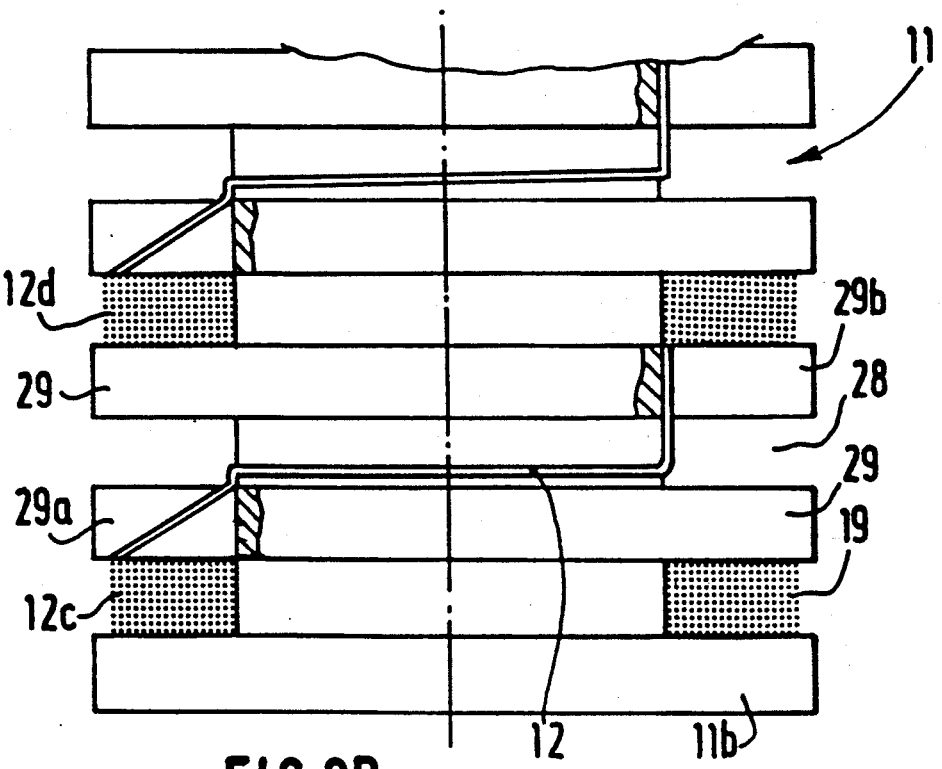
FIG. 3B shows diagrammatically how the high tension winding wire of one winding section extends from one winding compartment to another, neighboring, winding section in another compartment through two successive walls bounding the winding compartments and defining an insulating compartment.

Another special feature of the insulating body 11, as shown in FIG. 3B, lies in the fact that the walls 29, which delimit the insulating compartments 28 and the winding compartments 19, are formed with exit slots 29*a* and entry slots 29*b*. These slots allow the wire of the high tension winding 12 to pass, through each of the slots in turn, from one winding section 12*c* to the next, 12*d*, and so on. Thus, as is shown diagrammatically in FIG. 3B, after a winding section 12*c* has been wound, the wire can be led through the exit slot 29*a* of the wall 29 and into the insulating compartment 28. The exit slots 29*a* and the entry slots 29*b* are successively offset by 180 degrees. Accordingly, the wire is laid over the bottom of the insulating compartment 28 over 180 degrees so that it can pass through the next wall through the entry slot 29*b* therein the, so that the winding of the following section 12*d* can be carried out starting at this wall.

The secondary winding is subsequently impregnated with a suitable varnish of a known kind chosen for its adhesive qualities and for its ability to polymerise on itself after exposure to ultra violet radiation. Such a varnish is one that is made from an epoxide resin and an acrylic ester, for example of the UV MUT 5033 type marketed by Holden Europe. This impregnation may be carried out either by soaking, or with the use of a spray gun, or by drop-by-drop application, or by any other known method. The operation is thus easy to perform without calling for the use of significant special equipment, and is very rapid since drying by means of ultra violet radiation is virtually instantaneous.

Subsequently, the sub-assembly is encapsulated in a coating 30 of a thermoplastic material applied by a surface moulding process. The coating material may, for example, be polybutyleneterephthalate (PBTB), which has good thermal conduction qualities for the purposes of heat removal.

The varnish used in impregnation has a fundamental advantage of, firstly, setting up an interface for adhesion between the thermoplastic material of the insulating support 11 and the insulating enamel of the winding wire 12, and secondly the thermoplastic encapsulating material 30. This encapsulating material, for example of PBTB, adheres along the walls of the insulating compartments 28 so as to fill the latter. The insulating compartments thus act as baffles to the leakage paths, and thus increase the length of the leakage paths.

Figure 5:
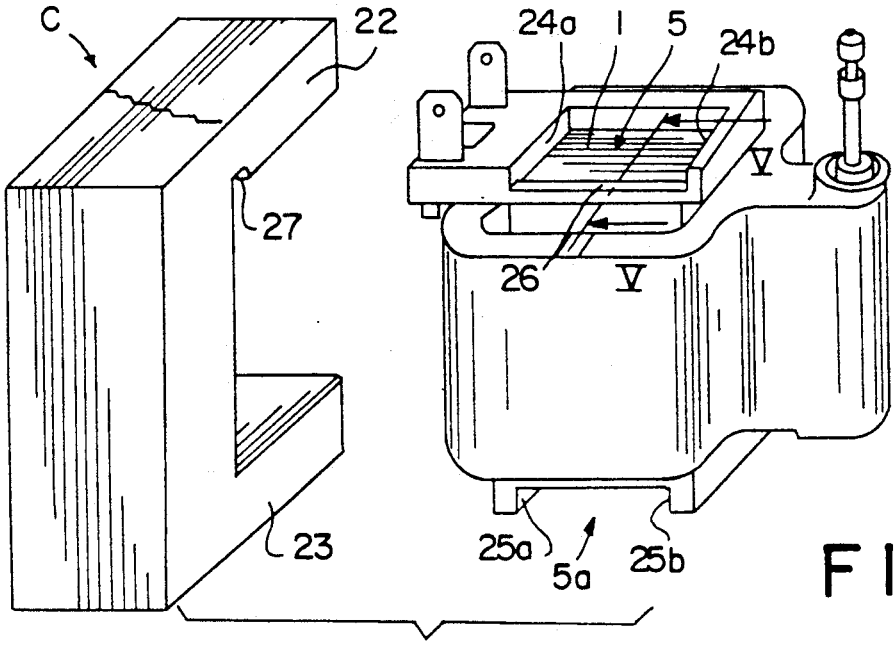
FIG. 5 shows the complete assembly of the coil, in an exploded perspective view.

The primary sub-assembly A and the secondary sub-assembly B, respectively shown in FIGS. 2 and 4, are assembled with the former supported within the latter in the manner shown in FIG. 5, this support being obtained using support means of the kind described in French published patent application No. FR 2 593 962A.

A magnetic flux coupling circuit C is arranged to bridge the ends of the magnetic core 1 through its branches 22 and 23. The magnetic circuit C is indexed into this position by means of a resilient clipping device, which is preferably formed, in the manner described in the above mentioned French patent application, of a retractable pad 26 which is formed by moulding on the surface portion 3*a* of the bobbin of body 3 of the primary sub-assembly A, and which is such that, after being retracted by resilient deformation, it will relax and anchor itself in a slot 27 which is formed in the inner base of the branch 22 of the magnetic circuit C.

Once the various elements or sub-assemblies A, B and C are assembled together, the whole is encapsulated with an insulating material so as to leave nothing exposed apart from the functional ends of the high tension output terminal 16 and of the two connecting terminals, namely the external knob 16*b* and the male terminal tags 9*b* and 10*b*. See FIG. 6.

The encapsulating material 38 may be similar to, or the same as, that which is used for the encapsulation 30 of the secondary sub-assembly B. The use of PBTB, for example a suitable thermoplastic polyester based on polytetramethyleneterephthalate resin, whether or not reinforced, leads to good results because of its coefficient of thermal expansion, which enables the magnetic circuit to undergo deformation due to the heating effect when the coil is working at full power.

In order to imporve the transfer of heat to the encapsulated material, it would be possible to add cooling fins to the outer profile which is created during the application of this material by surface moulding.

The invention is of course not limited to the embodiment described and shown above; and other methods and other embodiments of the ignition coil may be provided without departing from the spirit of the invention. For example, the thermoplastic encapsulation of the secondary sub-assembly B, and the encapsulation of the whole assembly comprising the elements A, B and C together, may with advantage be carried out in a single moulding operation.

What is claimed is:

1. An ignition coil having primary and secondary winding assemblies for automotive internal combustion engines, said secondary winding assembly comprising:

an insulating assembly body having a central axis and a plurality of walls, said plurality of walls defining a plurality of winding compartments alternating with insulating compartments in the direction of said central axis;

a divided high tension winding comprising a wire having a plurality of winding sections distributed in respective said winding compartments, wherein said walls have connecting slots extending therethrough such that said winding sections are connected to each other in series by said wire passing through said connecting slots, and wherein said connecting slots are successively offset with respect to each other;

said secondary winding assembly having an adhesive varnish able to polymerize on itself after exposure to ultraviolet radiation impregnated therein, said adhesive varnish comprising a composition of epoxide resin and acrylic ester, and said secondary sub-assembly further being encapsulated with an insulating envelope of thermoplastic material.

2. The ignition coil as set forth in claim 1, wherein said thermoplastic material is polybutyleneterephthalate.

* * * * *